US006345746B1

(12) United States Patent
Oktay et al.

(10) Patent No.: US 6,345,746 B1
(45) Date of Patent: Feb. 12, 2002

(54) DETACHABLE ANKLE-PACK USED WITH IN-LINE SKATES

(76) Inventors: Feza D. Oktay, 36 Hillcrest Rd., Needham, MA (US) 02492; Sevgin Oktay, 097 Fox Run, Poughkeepsie, NY (US) 12603

( * ) Notice: Subject to any disclaimer, the term of this patent is extended or adjusted under 35 U.S.C. 154(b) by 0 days.

(21) Appl. No.: 09/669,808

(22) Filed: Sep. 26, 2000

Related U.S. Application Data

(60) Provisional application No. 60/160,746, filed on Oct. 21, 1999.

(51) Int. Cl.[7] ..... A45F 5/00

(52) U.S. Cl. ..... 224/222; D3/226; 224/575; 224/610; 224/645; 224/657; 280/811

(58) Field of Search ..... 224/222, 575, 224/607, 610, 645, 657; 280/811, 816; D3/226

(56) References Cited

U.S. PATENT DOCUMENTS 3,322,311 A * 5/1967 Homer ..... 224/222
D258,246 S * 2/1981 Kravchenko ..... D3/226
4,341,332 A * 7/1982 McDougall ..... 224/222
4,601,418 A * 7/1986 Gruzensky ..... 224/222
4,881,671 A * 11/1989 Horton et al. ..... 224/222
4,905,881 A * 3/1990 Graber ..... 224/222
D329,021 S * 9/1992 Robbins ..... D3/226
5,148,949 A * 9/1992 Luca ..... 224/222
D340,806 S * 11/1993 Gonzalez ..... D3/226
5,269,580 A 12/1993 Hsiao
5,351,370 A * 10/1994 Fields et al. ..... 224/222
D358,705 S * 5/1995 Saggese, Jr. ..... D3/226
D358,932 S * 6/1995 Barton et al. ..... D3/226
5,570,824 A 11/1996 Lyon
5,664,719 A 9/1997 Bigham
5,826,771 A 10/1998 Peng
5,988,467 A * 11/1999 Brustein ..... 224/222

* cited by examiner

*Primary Examiner*—Stephen P. Garbe
(74) *Attorney, Agent, or Firm*—Sevgen Oktay

(57) ABSTRACT

An ankle-pack device is disclosed which allows the user to utilize in-line skates as a means of transportation without the necessity for a shoe carrying device usually attached to the upper portions of the body such as a back pack or belt pack. Shoes can easily be carried directly next to the in-line skate utilizing the disclosed device while in motion as well. Thus, the ankle-pack system or device leaves the upper portions of the body uninhibited during skating. Also, ankle-pack is fitted with an expandable bottom to accommodate the larger in-line skate when they are to be carried after the conclusion of skating. An additional extension strap provides the length needed to carry the ankle-pack on the shoulder.

8 Claims, 4 Drawing Sheets

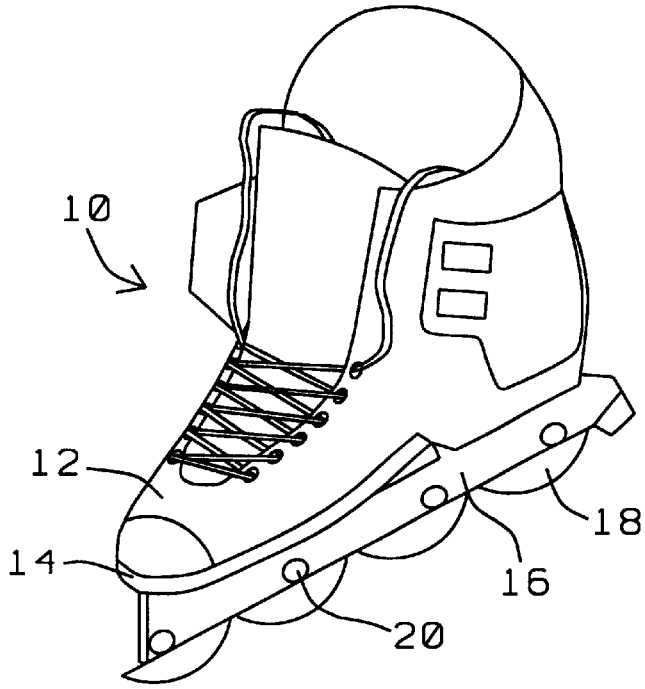
FIG. 1a – Prior Art
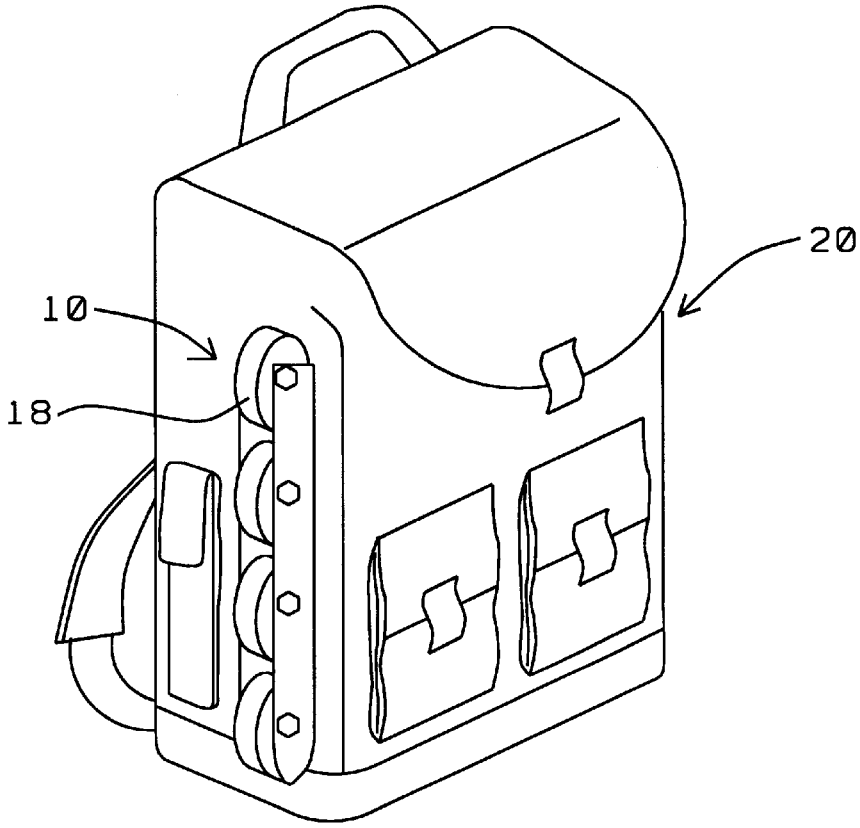
FIG. 1b – Prior Art

DETACHABLE ANKLE-PACK USED WITH IN-LINE SKATES

This application claims benefit of provisional application No. 60/160,746, filed Oct. 21, 1999.

BACKGROUND OF THE INVENTION (1) Field of the Invention

The present invention relates to in-line skates in general, and to a detachable ankle-pack that can be worn around in-line skates while in motion.

(2) Description of the Related Art

It is usually the case with a sports activity that all or some of the normal clothes that are worn must be removed in order to wear the sports-wear appropriate for that particular activity. Then there is the problem of either carrying the removed clothes, or leaving them to be retrieved later. Such is the case with in-line skating where shoes must be removed in order to wear the skates. It is usually desirable to carry the shoes- and any other accessories, for that matter- during skating so that they can be worn again, or used, any time on the way rather than having to come back for them.

In prior art, more attention is given to how to carry the in-line skates themselves than the regular shoes that are removed from feet. A conventional in-line skate is partially shown in FIG. 1*a*. Skate (10) has a boot (12) formed with a sole (14) to which is affixed an inverted-channel shaped in-line frame (16). A plurality of rollers (18) (here shown as four in number) is supported in line within the channel (16) on axles (20). Only the lower portions of rollers (18) extend below the level of channel (16). FIG. 1*b* shows a conventional back pack (20) for carrying skate (10) where rollers (18) protrude from the side of the back pack.

Hsiao, in U.S. Pat. No. 5,269,580 shows another in-line skate carrier comprising a body having two laterally paced pockets each having side supports dimensioned to engage opposite sides of the skate channel to hold the boots side-by-side and having a hook to hook around one of the rollers. The forward ends of the pocket-forming portions are connected by a transverse member to which a carrying handle is attached. A retainer is resiliently attached to the body to apply pressure to the boots to prevent them from popping out of the pockets.

Bigham, et al., in U.S. Pat. No. 5,664,719 disclose another skate carrier apparatus with retractable strap. The apparatus comprises a base member having a front, back and bottom. The base member defines first and second slots, each open to the bottom and extending from the front to the back. The first and second slots are each sized to receive the blade of an in-line skate having blades that include at least two adjacent wheels so that the base member is substantially perpendicular to the in-line skate blades.

In U.S. Pat. No. 5,826,771, Peng describes a different back pack for carrying in-line skates. The back pack includes a relatively large central compartment having a lateral shape in section somewhat resembling that of an in-line skate or ice skate with its integral boot. The sides of the central compartment include fixed loops and openable adjustable straps for removably securing one of a pair of skates to each side. The back of the central compartment includes a removable and adjustable helmet retaining net, providing for the removable retention of an in-line skating helmet or the like externally on the back of the pack. The pack includes adjustable padded shoulder strap loops extending from the upper front to the lower front of the central compartment, and a padded hip support belt extending from one side to the other across the front of the lower compartment. The pack thus provides for the external carriage of relatively large and bulky articles used in skating, such as the skates and helmet, while also providing for the internal carriage and storage of the other associated equipment, such as knee and elbow guards, maintenance and repair equipment of the skates, and perhaps a change of clothing or other articles as desired.

On the other hand, Lyon, et al., in U.S. Pat. No. 5,570,824 describe a lightweight, convertible sling/waist-belt carrier for carrying shoes and large boots, particularly in-line skates, in a side-by-side relation. The carrier may be selectively hung from the shoulder of a person when holding boots, skates or shoes or it can be worn about the waist of the person when carrying shoes. The carrier includes a strap assembly which wraps around the footwear in connection with a large strap which serves as a shoulder strap/waist belt. The footwear strap assembly is composed of a thin strap arranged in a figure eight with the loops of the figure eight encompassing designated portions of the footwear.

It will be apparent to those skilled in the use of in-line skates that it would be desirable to have a device which can carry shoes and other accessories, and at the same time does not limit the motion of the upper parts of the body as a back pack or a belt pack would. It is disclosed later in the embodiments of the present invention a pouch device that can be detachably attached to the ankle portion of the in-line skate for ease of carrying regular shoes while skating. The ankle pouch or pack can also be detached and reconfigured to be used as a shoulder carrier for the in-line skate and other accessories.

SUMMARY OF THE INVENTION

It is therefore an object of this invention to provide an ankle-pack system or device which allows the user to utilize in-line skates as a means of transportation without the necessity of a carrying device for shoes to be attached to the upper portions of the body such as a back pack or belt pack. Shoes can easily be carried directly next to the in-line skate utilizing this device while in motion as well.

It is another object of this invention to provide an ankle-pack system for carrying regular shoes and other accessories and is detachably attached to in-line skates via Velcro straps around the ankle portion and through the foot portion of the skates.

It is still another object of the present invention to provide an ankle-pack system to hold shoes and other accessories while attached to the in-line skates, and yet can also be opened and reconfigured to hold in-line skates.

These objects are accomplished by providing an oblong pouch pack made of a flexible material to be wrapped around the ankle portion of a boot adapted to be worn by a person; said pouch pack having a first end with a first strap and a second end with a second strap, each of which is formed integrally with said pouch pack; said pouch pack having a zippered central compartment formed by a frontal outside portion and an inner backside portion, wherein said backside portion wraps around said ankle portion of said boot; said pouch pack being securable onto said ankle portion of said boot by wrapping around and fastening said first and second straps together; said pouch pack also having a plurality of side straps to secure said ankle-pack system additionally to said boot; and an extension strap which is detachably attached to said first strap and said second strap so that said ankle-pack can also be adapted to carry said in-line skate over a shoulder.

BRIEF DESCRIPTION OF THE DRAWINGS

FIG. 1*a* shows an in-line skate of prior art.

FIG. 1*b* shows a back pack of prior art for carrying in-line skates.

DESCRIPTION OF THE PREFERRED EMBODIMENTS

Figure 2A:
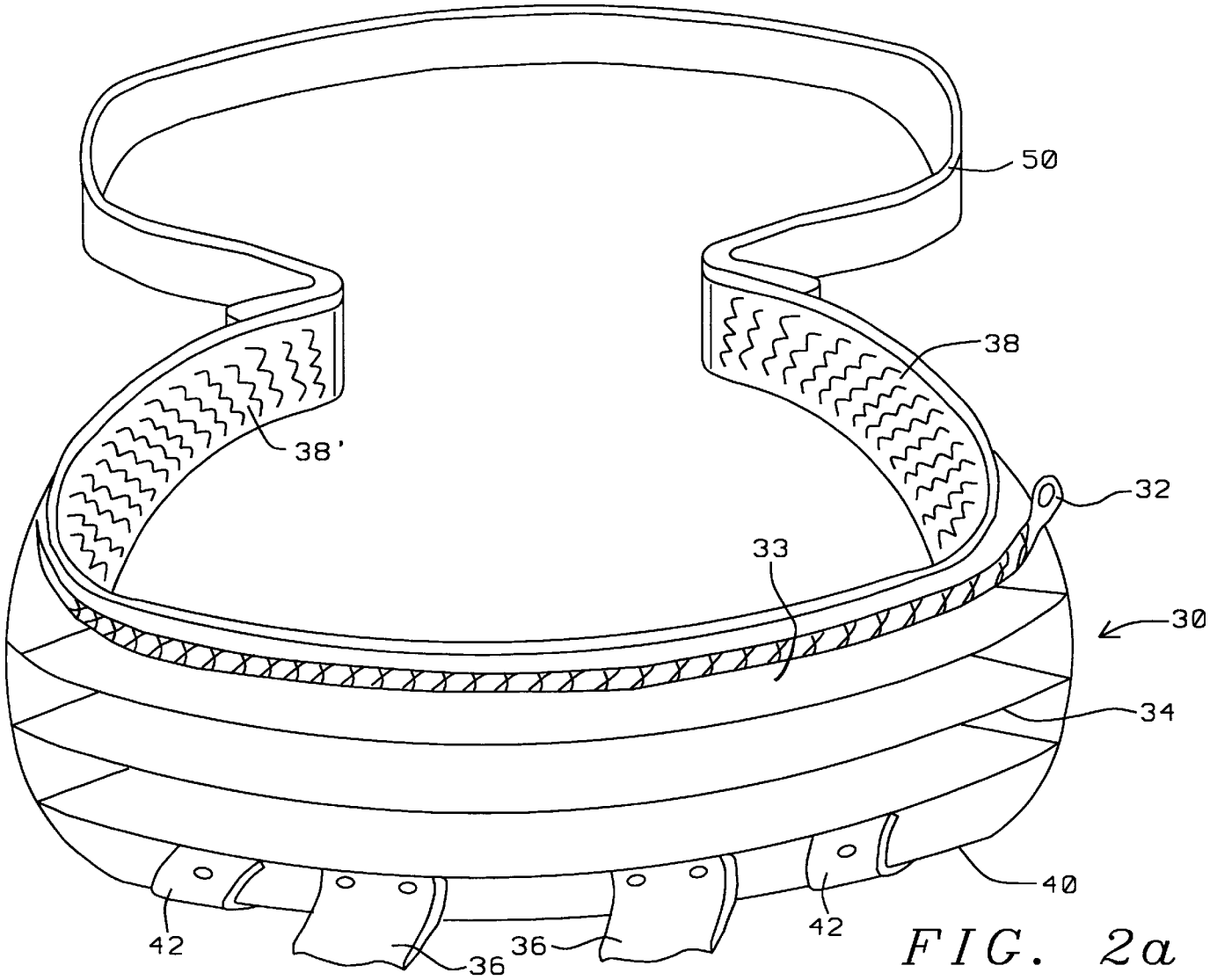
FIG. 2*a* shows the ankle-pack system or device of this invention having an expandable central compartment with a zipper and straps for attachment to the ankle portion of an in-line skate.
Figure 2B:
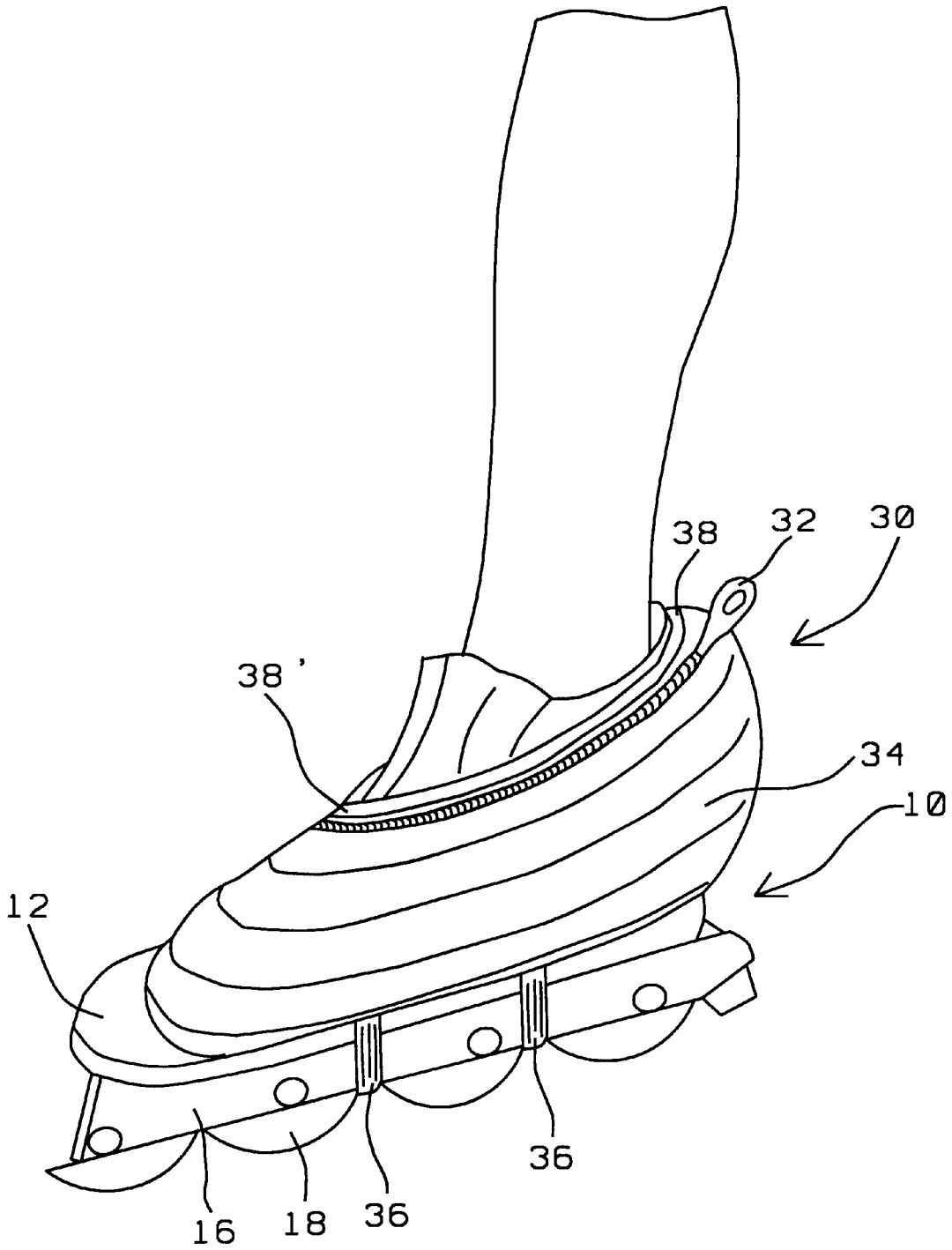
FIG. 2*b* shows the attachment of the ankle-pack system of this invention to an in-line skate.
Figure 2C:
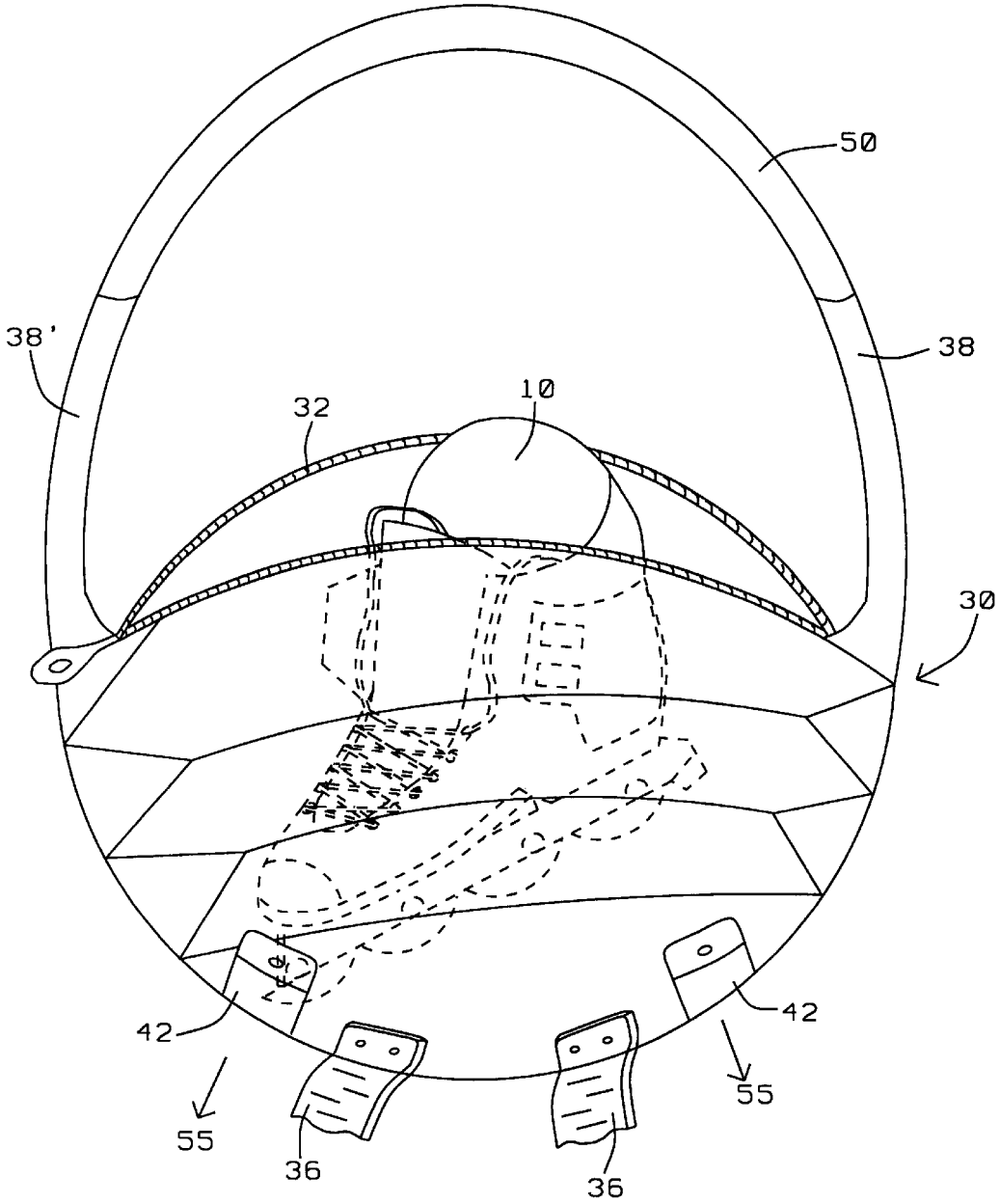
FIG. 2*c* shows the enlarging of the ankle-pack system of this invention to carry in-line skates with an extension shoulder strap.

Referring now to drawings FIG. 2*a*–2*c*, there is shown an ankle-pack system device comprising a bag or an oblong pouch pack (30) having two ends (38) and (38') integrally formed with the pouch pack. The pouch pack is made of a flexible material so that it can be wrapped around the ankle portion of a boot, such as shown in FIG. 1*a*. A main feature of the disclosed ankle-pack system is that it can be used to carry walking shoes in it as it is secured by wrapping and strapping the two ends around the ankle portion of an in-line skate boot, thus freeing other parts of the body from the burden of carrying shoes, and other accessories, for that matter. The ankle-pack system also includes extension strap (50) which can be used to convert the ankle system to a shoulder system with an expanded pouch-pack as described below so that in-line skates may now be carried in it by replacing them with the walking shoes after the completion of in-line skating.

Specifically in FIG. 2*a*, pouch pack (30) of an ankle-pack system comprises a central zippered compartment (34) large enough to accommodate one shoe (not shown). Two ankle-packs, one for each foot, are employed to carry two shoes. Compartment (34) is accessible by opening zipper (32) as shown in the same FIG. 2*a*, and has multiple folds, preferably four, so that it can expand to accept a shoe comfortably. The backside portion, (33), is not expandable so as to provide a relatively smooth surface to mate with the outside surface of in-line skate (10) as shown in FIG. 2*b*.

A main feature and key aspect of the instant invention is strap (38) shown in FIG. 2*a* which is an integral pat of the ankle-pack and is capable of going around the ankle portion of the boot of in-line skate (10) shown in, FIG. 2*b* in order to secure the ankle-pack to the upper portion of the boot. It is preferred that the ends of strap (38) are of opposite engageable or lockable surface texture so as to lock together when pressed onto each other, as is commonly practiced, for example with the well-known VELCRO straps It is also possible to have one type of lockable surface texture on selected areas (not shown) of the boot, and the opposite lockable surface texture on straps (38) and (38') so that pouch pack (30) can be secured to the boot when the strap is pressed onto the VELCRO-like patches on the boot.

Side straps (36) shown in FIG. 2*a* are also a key aspect of the invention so as to provide a secure attachment of the ankle-pack system of the present invention to the lower portion of the in-line skate. Side straps (36) are drawn taught in between wheels (18) and attached to the underside portion of frame (16) in any number of ways (not shown). However, it is important that side straps (36) do not engage the wheels as shown in FIG. 2*b*.

In another embodiment of the instant invention, a folded bottom (40) is provided for extension in the downward directions (55) as shown in FIG. 2*c*. After skating, the ankle-pack can be removed from the in-line skate, and likewise the shoes therein, and then enlarged by undoing fasteners (42) shown in the same Figure to accept one of the in-line skates. In same procedure can be repeated with the other ankle-pack for the other foot. Now, with an extension strap (50) shown in FIG. 2*a*, the two ankle-packs, with the in-line skates therein, can be carried on one or two shoulders.

In still another embodiment, the two ankle-packs of FIG. 2*c* for each boot can be reconfigured by attaching respective side straps (36) together to form a single bag in which both in-line skates can be carried. Straps (38) and (38') join with extension strap (50) to become a handle for carrying the joined bag (not shown).

It will be understood that the ankle-pack device of this invention can be made out of those conventional materials that are flexible yet durable and used for sports bags and knapsacks to carry shoes and other similar items.

While the invention has been particularly shown and described with reference to the preferred embodiments thereof, it will be understood by those skilled in the art that various changes in form and details may be made without departing from the spirit and scope of the invention.

What is claimed is:

1. A detachable ankle-pack system comprising:

an oblong pouch pack (30) made of a flexible material to be wrapped around the ankle portion of a boot adapted to be worn by a person;

said pouch pack having a first end with a first strap (38) and a second end with a second strap (38'), each of which is formed integrally with said pouch pack;

said pouch pack having a zippered (32) central compartment (34) formed by a frontal outside portion (34), an inner backside portion (33) and a bottom portion (40) wherein said backside portion wraps around said ankle portion of said boot;

said pouch pack being securable onto said ankle portion of said boot by wrapping around and fastening said first and second straps together;

said pouch pack also having a plurality of side straps (36) to secure said ankle-pack system additionally to said boot; and an extension strap (50) which is detachably attached to said first strap and said second strap so that said ankle-pack pack can also be adapted to carry said in-line skate over a shoulder.

2. The detachable ankle-pack of claim 1, wherein said first strap has a first type of a lockable surface texture.

3. The detachable ankle-pack of claim 2, wherein said second strap has a second type of a lockable surface texture opposite to that of said first strap.

4. The detachable ankle-pack of claim 1, wherein said fastening is accomplished by pressing first and second straps together.

5. The detachable ankle-pack of claim 1, wherein said frontal outside portion of said pouch pack has a plurality of folds which can expand laterally to accept additional objects.

6. The detachable ankle-pack of claim 1, wherein said bottom portion has a plurality of folds which can expand downwardly to accept large objects such as said boot.

7. The detachable ankle-pack of claim 1, wherein said side straps are wrappable around and underneath said boot, and between rollers in the case of an in-line skate.

8. The detachable ankle-pack of claim 1, wherein said extension strap has two ends, each end of a lockable surface texture opposite to the lockable surface texture of said first and second straps of said ankle-pack.

* * * * *